US005628576A

United States Patent [19]

Smith

[11] Patent Number: 5,628,576

[45] Date of Patent: May 13, 1997

[54] PRESSURIZED REFILL WITH DOUBLE SEAL VALVE CORE PLUG AND A METHOD FOR PRESSURIZING A REFILL

[75] Inventor: Paul A. Smith, Glenview, Ill.

[73] Assignee: Eversharp Pen Company, Franklin Park, Ill.

[21] Appl. No.: 437,017

[22] Filed: May 8, 1995

[51] Int. Cl.[6] ..... B43K 7/03

[52] U.S. Cl. ..... 401/190; 401/188 R; 401/188 A

[58] Field of Search ..... 401/141, 142, 401/187, 188 R, 188 A, 190

[56] References Cited

U.S. PATENT DOCUMENTS

| | | | |
|---|---|---|---|
| 224,162 | 2/1880 | Fisher et al. | 401/187 |
| 810,470 | 1/1906 | Davey | 401/188 |
| 2,787,249 | 4/1957 | Barlow et al. | 401/188 R X |
| 3,115,868 | 12/1963 | DeMolin et al. . | |
| 3,420,610 | 1/1969 | Malm . | |
| 3,425,779 | 2/1969 | Fisher et al. . | |
| 3,775,015 | 11/1973 | Tsunoda et al. . | |
| 3,997,273 | 12/1976 | Germann . | |
| 4,498,797 | 2/1985 | Peper et al. . | |
| 4,587,999 | 5/1986 | Boiko et al. . | |

FOREIGN PATENT DOCUMENTS

| | | | |
|---|---|---|---|
| 316210 | 5/1989 | European Pat. Off. | 401/188 R |
| 624703 | 9/1961 | Italy | 401/188 A |
| 253356 | 11/1948 | Switzerland | 401/188 |
| 800 | 3/1860 | United Kingdom | 401/188 A |

*Primary Examiner*—Steven A. Bratlie
*Attorney, Agent, or Firm*—Hill, Steadman & Simpson

[57] ABSTRACT

A pressurized refill and a method for pressurizing a refill are provided. The refill has a plug secured at an end of the refill having at least one seal and preferably two seals between the plug and an interior wall of the refill. A valve extends through a channel of the plug allowing pressurized gas to be forced into an interior of the refill to pressurize or re-pressurize the interior of the refill. A spring loaded stem maintains the valve in a closed and sealed position when pressurization is not being effected.

14 Claims, 1 Drawing Sheet

PRESSURIZED REFILL WITH DOUBLE SEAL VALVE CORE PLUG AND A METHOD FOR PRESSURIZING A REFILL

BACKGROUND OF THE INVENTION

The present invention generally relates to a pressurized refill for a pen. More specifically, the present invention relates to a sealed plug having a valve for use in selectively pressurizing a pen refill as well as sealing the refill.

It is, of course, generally known to provide a writing instrument with ink therein, commonly referred to as a pen. Often, pens are provided with a cartridge or a refill such that when the ink within the pen or refill is fully depleted, only the refill requires replacement. As a result, a number of decorative pen housings can be provided to receive a standard refill so that the housing can be repeatedly used, and replacement of the refill only is required.

It is also generally known to provide a refill with ink therein that is constantly acted upon by gas pressure. Such refills, when in use within pens, allow for a smooth and continuous flow of ink regardless of the orientation of the pen itself. However, such pressurized pen refills are typically only sealed at an end of the refill. Therefore, the gas pressurizing the refill slowly leaks from the refill rendering the ink refill inoperative or, at least, less effective.

Further, recharging of the refill with gas is often impossible or difficult to achieve. Therefore, after the gas is discharged from the refill or .substantially reduced, the refill may become inoperative. This results in a substantially shorter shelf-life for the refill.

A need, therefore, exists for an improved refill having a valved core plug and at least one seal peripherally extending around the plug. Further, an improved method for recharging a refill with a gas is also required.

SUMMARY OF THE INVENTION

The present invention provides a refill pressurized with a gas having a plug and valve constructed and arranged to selectively permit the gas to enter a barrel of the refill to pressurize the same. Further, a method is provided for pressurizing a refill with a gas.

To this end, in an embodiment, a refill pressurized with a gas is provided having a barrel having an interior defined between a first end and a second end wherein the first end terminates in a writing tip and further wherein the interior contains ink therein. A plug is insertable into the second end of the barrel having at least one seal around the periphery of the plug sealing the plug and the interior of the barrel. A valve means is constructed and arranged to selectively permit the gas to enter the interior of the barrel through the plug.

In an embodiment, a spring is associated with the valve means and is biased to maintain the valve means in a closed position.

In an embodiment, a cap is provided at the second end of the barrel enclosing the barrel and the plug.

In an embodiment, a seat is formed in an interior of the plug.

In an embodiment, the plug includes two seals around the periphery.

In an embodiment, at least one seal forms a seal between the valve means and the plug.

In an embodiment, at least one seal peripherally surrounds the plug intermediate its length.

In an embodiment, a stem is connected to the valve means extending through the plug.

In an embodiment, a follower is provided in the barrel capable of floating on a surface of the ink.

In an embodiment, an outside diameter of the seal is greater than an outside diameter of the valve means.

In another embodiment of the present invention, a method is provided for pressurizing a refill with a gas. The method comprises the steps of: providing a barrel having an interior capable of holding ink therein wherein the interior is defined between a first end and a second end and further wherein the first end terminates in a writing tip; inserting a plug through the second end of the barrel wherein the plug has a peripheral seal capable of sealing the interior of the barrel; providing a valve constructed and arranged to seal an end of the plug; and selectively pressurizing the ink in the barrel of the refill by forcing the gas through the plug past the valve at the end of the plug.

In an embodiment, the method further comprises the step of providing a second peripheral seal around the plug.

In an embodiment, the method further comprises the step of providing a spring to bias the valve in a closed position.

In an embodiment, the method further comprises the step of providing a follower in the barrel capable of following the ink in the barrel between the plug and the writing tip.

In an embodiment, the method further comprises the step of providing a removable cap covering the second end of the barrel and enclosing the plug in the barrel.

In an embodiment, the valve has a diameter less than an outer diameter of the peripheral seal.

In an embodiment, the method further comprises the step of providing a stem connected to the valve and extending through an interior of the plug.

In another embodiment of the present invention, a pen refill pressurized with a gas is provided wherein the refill has a shell having walls defining an interior between a first end and a second end. Ink is provided within the interior of the shell, and a writing tip terminates the first end of the shell. Plug means is insertable through the second end of the shell, and a seal means is constructed and arranged between the plug means and the shell. A valve means associated with the plug means is capable of selectively allowing the gas to enter the interior of the shell.

In an embodiment, a spring biases the valve means in a closed position.

In an embodiment, the seal means includes at least two peripheral seals constructed and arranged between the plug means and the shell.

It is, therefore, an advantage of the present invention to provide a system and a method for pressurizing a pen refill.

Another advantage of the present invention is to provide a system and a method for maintaining the pressure in a pressurized refill.

A further advantage of the present invention is to provide a system and a method for refilling a pressurized refill with gas.

Yet another advantage of the present invention is to provide a system and a method for improving the shelf-life of a pen refill.

And, another advantage of the present invention is to provide a system and a method for prolonging freshness of ink contained within a refill.

A still further advantage of the present invention is to provide a system and a method for recharging of gas within a refill at any time.

Moreover, an advantage of the present invention is to provide a refill and a method for refilling that has improved overall writing performance and smoothly flowing ink without clogging, blobbing and/or messiness.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a pen refill and a method for refilling a pen with a gas to pressurize the ink within the refill. In a preferred embodiment, the refill includes a double sealed plug with a valve extending therethrough for pressurizing the refill with a gas.

Figure 1:
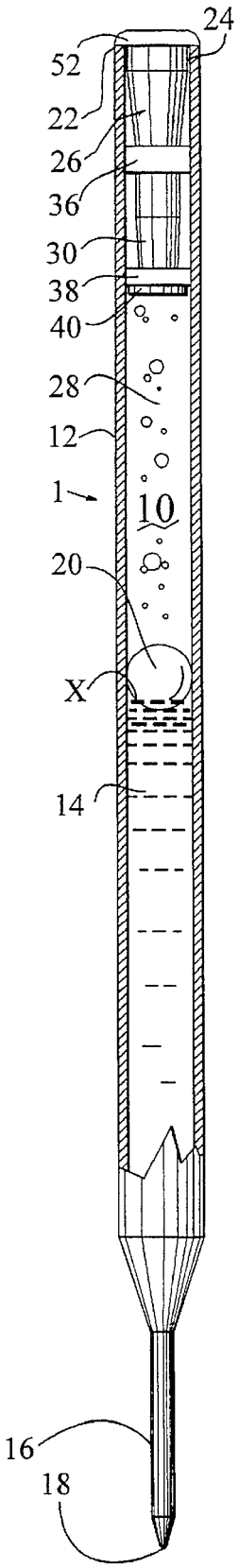
FIG. 1 illustrates a cross-sectional view of an embodiment of a pen refill of the present invention.

Referring now to the drawings wherein like numerals refer to like parts, FIG. 1 illustrates a refill 1 having an interior 10 defined by a body 12 partially filled with ink 14. The body 12 is substantially and uniformly cylindrical along its length and tapers toward its distal end 16 and forms a writing tip 18, such as a ball point. The ink 14 supports a follower 20 at a level X as shown in FIG. 1. Therefore, the ink 14 is contained within the body 12 of the refill 1 between the follower 20 at the level X and the writing tip 18 at the distal end 16. At an opposite end 22 from the distal end 16 is an opening 24 through which a plug 26 can be inserted. Between the plug 26 and the follower 20 is a pressurized gas generally designated at 28. The gas 28 is pressurized to maintain a constant and continuous pressure on the follower 20 such that the ink 14 evenly and continuously flows through the writing tip 18 when the refill 1 is used, for example, within a pen housing (not shown).

Figure 2:
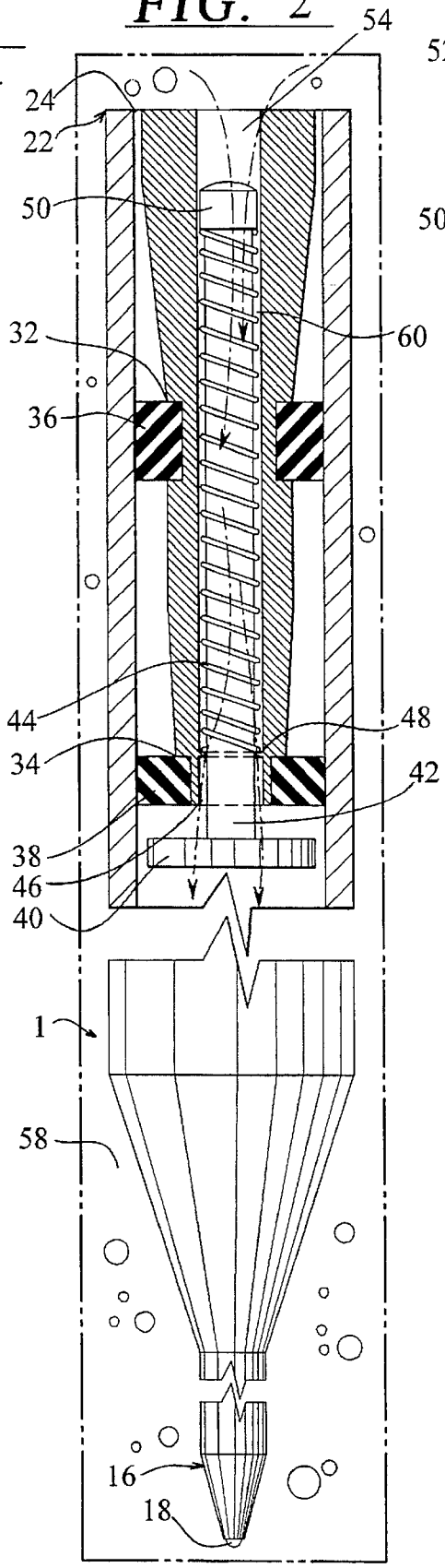
FIG. 2 illustrates an enlarged cross-sectional view, partially cut away, of an embodiment of the pen refill system in a gas recharging mode.
Figure 3:
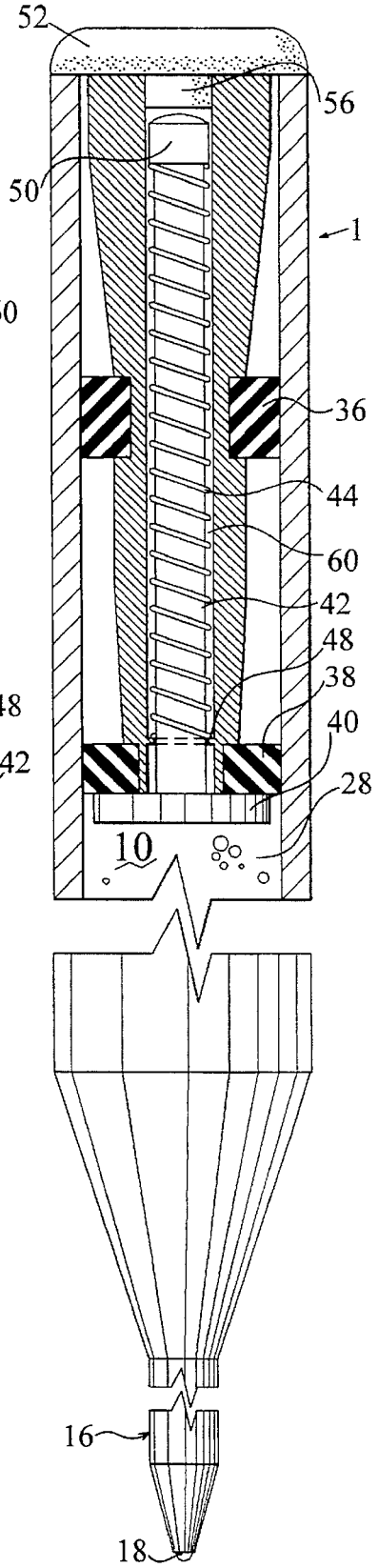
FIG. 3 illustrates an enlarged cross-sectional view, partially cut away, of an embodiment of the pen refill system following gas recharging.

As illustrated in FIG. 1, and more clearly shown in FIGS. 2 and 3, the plug 26 includes a body 30. Around the body is a first recess 32 and a second recess 34. Secured around each of the recesses 32,34 is a seal 36,38, respectively. Preferably, two seals are implemented but a single seal or more than two seals may be implemented by those skilled in the art. The first seal 36 is located intermediate the ends of the plug 26. The second seal 38 is preferably located at an end of the plug 26. With the seal 28 at the end of the plug 26, a valve 40, in its closed position as shown in FIGS. 1 and 3, rests against the seal 38 and positively seals the interior 10 of the refill 1.

As illustrated in FIGS. 2 and 3, the valve 40 has a stem 42 attached thereto. Around the stem 42 is a spring 44. The spring 44 is biased to maintain the valve 40 and the stem 42 in the position illustrated in FIG. 3 such that the valve 40 closes and seals an opening 46 formed in an end of the plug 26. Within the plug 26 is a seat 48 on which the spring 44 rests preventing further advancement of the spring 44. On an opposite end of the stem 42 is a cap 50 providing a seat for an opposite end of the spring 44. A second cap 52 may be further provided to enclose the opening 24 as well as the opening 54 at the end of the plug 26 and the end 22 of the body 12 of the refill 1 is shown. The cap 52 is removable and includes a plug 56 insertable into the opening 54 at the end of the plug 26.

Referring now to FIG. 2, charging of the refill 1 with a gas 58 such that the gas 58 enters into the interior 10 of the refill 1 is shown. In an embodiment, the refill 1 or a plurality of refills may be placed within a pressurized chamber and the gas 58 may be forced through a channel 60 formed through the plug 26 in the direction of the arrows in FIG. 2. The pressurized gas forces the valve 40 and hence the spring 44 and stem 42 to the position illustrated in FIG. 2. Entry of the pressurized gas 58 into the interior 10 of the refill 1 is thereby achieved.

Following release of the pressurized gas 58 forcing entry of the gas into the interior 10 of the refill 1, the cap 52 may be secured to the end 22 of the refill 1 enclosing the opening 24 of the refill 1 and the opening 54 of the plug 26. As shown in FIG. 3, the seals 36 and 38 prevent release of the gas 28 within the interior 10 of the refill 1. As a result, an effective method is provided for initially charging or recharging of a refill as well as effectively maintaining the pressurized gas 28 within the interior 10 of the refill 1.

It should be understood that each of the refills 2 may be individually charged by application of a pressurized gas source to the end 22 of the refill forcing pressurized gas through the channel 16 and into the interior 10 of the refill 1. Of course, other known gas pressurizing methods may be implemented using the plug 26, valve 40 and arrangement of seals 36, 38 of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A refill pressurized with a gas, the refill comprising:

a barrel having a wall defining an interior defined by the wall extending between a first end and a second end, the first end terminating in a writing tip wherein the interior contains ink therein;

a plug having an interior insertable into the second end of the barrel having at least one seal around the periphery of the plug to seal the plug against the wall in the interior of the barrel;

a cap removably secured to the second end of the barrel wherein removal of the cap does not affect the ink sealed in the barrel by the plug; and valve means constructed and arranged to selectively permit the gas to enter the interior of the barrel through the interior of the plug wherein the valve means has a stem extending into the interior of the plug and further wherein the stem includes a spring associated with the valve means and biased to maintain the valve means in a closed position wherein the spring extends into the interior of the plug.

2. The refill of claim 1 further comprising:

a seat formed in an interior of the plug.

3. The refill of claim 1 wherein the plug includes two seals around its periphery.

4. The refill of claim 1 wherein at least one seal forms a seal between the valve means and the plug.

5. The refill of claim 1 wherein the at least one seal peripherally surrounds the plug intermediate its length.

6. The refill of claim 1 further comprising:

a follower in the barrel capable of floating on a surface of the ink.

7. The refill of claim 1 wherein an outside diameter of the seal is greater than an outside diameter of the valve means.

8. A method for pressurizing a refill with a gas, the method comprising the steps of:

providing a barrel having walls defining an interior capable of holding ink therein wherein the interior is defined by the walls extending between a first end and a second end and further wherein the first end terminates in a writing tip;

inserting a plug having an interior through the second end of the barrel wherein the plug has a peripheral seal capable of sealing the plug against the walls in the interior of the barrel;

providing a valve constructed and arranged to seal an end of the plug wherein the valve has a stem extending into the interior of the plug;

providing a cap removably secured to the second end of the barrel wherein removal of the cap does not affect the gas pressurized in the refill;

providing a spring associated with the valve extending along the stem into the interior of the plug to bias the valve in a closed position; and selectively pressurizing the ink in the barrel of the refill by forcing the gas through the plug past the valve at the end of the plug.

9. The method of claim 8 further comprising the step of:

providing a second peripheral seal around the plug.

10. The method of claim 8 further comprising the step of:

providing a follower in the barrel capable of following the ink in the barrel between the plug and the writing tip.

11. The method of claim 8 wherein the valve has a diameter less that an outer diameter of the peripheral seal.

12. The method of claim 8 further comprising the step of:

providing a stem connected to the valve and extending through an interior of the plug.

13. A pen refill pressurized with a gas, the refill comprising:

a shell having walls defining an interior defined by the walls extending between a first end and a second end;

ink within the interior of the shell;

a writing tip terminating the first end of the shell;

plug means having an interior insertable through the second end of the shell wherein the plug means includes a stem extending into the interior of the plug means;

seal means constructed and arranged around a periphery of the plug means to seal the plug means against the walls in the interior of the shell;

valve means associated with the plug means capable of selectively allowing the gas to enter the interior of the shell;

cap means removably secured to the second end of the shell wherein removal of the cap means does not affect the ink sealed in the shell; and a spring associated with the stem extending in the interior of the plug means to bias the valve means in a closed position.

14. The refill of claim 13 wherein the seal means includes at least two peripheral seals constructed and arranged between the plug means and the shell.

* * * * *